US006736388B2

(12) United States Patent
Lawrence

(10) Patent No.: US 6,736,388 B2
(45) Date of Patent: May 18, 2004

(54) IMAGE PROCESSING MACHINE HAVING A POST-PROCESSING AUTOMATED SHEET STACK BINDING SYSTEM

(75) Inventor: Fredrick J. Lawrence, Tustin, CA (US)

(73) Assignee: Gradco (USA), Inc., Irvine, CA (US)

( * ) Notice: Subject to any disclaimer, the term of this patent is extended or adjusted under 35 U.S.C. 154(b) by 0 days.

(21) Appl. No.: 10/245,021

(22) Filed: Sep. 17, 2002

(65) Prior Publication Data

US 2004/0051227 A1 Mar. 18, 2004

(51) Int. Cl.[7] ..... B42C 9/00

(52) U.S. Cl. ..... 270/58.08; 270/58.07; 412/8; 412/36; 412/901; 412/902

(58) Field of Search ..... 270/58.07, 58.08; 412/8, 33, 34, 36, 37, 901, 902; 156/384, 573, 908

(56) References Cited

U.S. PATENT DOCUMENTS 4,151,037 A * 4/1979 Klingelhoefer et al. ..... 156/468
4,586,640 A * 5/1986 Smith ..... 227/14
4,828,645 A * 5/1989 Van Bortel ..... 156/384
4,958,974 A * 9/1990 Schenk ..... 412/37
5,172,179 A * 12/1992 Tani et al. ..... 399/408
5,195,689 A * 3/1993 Beer et al. ..... 242/588.6
5,213,317 A * 5/1993 Mandel et al. ..... 270/58.11
5,441,374 A * 8/1995 Kosanke et al. ..... 412/11
5,536,044 A 7/1996 Luhman et al.
5,613,711 A 3/1997 Parker
5,678,861 A * 10/1997 Werner ..... 281/21.1
5,829,938 A 11/1998 Hartwig
6,006,807 A * 12/1999 Domes et al. ..... 156/521
6,155,763 A 12/2000 Parker et al.
6,330,999 B2 * 12/2001 Coombs et al. ..... 270/58.18
6,402,450 B1 6/2002 Kritzinger
6,450,492 B1 * 9/2002 Coombs et al. ..... 270/58.08

* cited by examiner

*Primary Examiner*—Patrick Mackey

(57) ABSTRACT

In an image processing machine, having a housing, and including, within the housing, at least one sheet stack accumulation station at which a stack of sheets having been operated on by the image processing machine are accumulated, a method and apparatus for automated post processing sheet stack binding is disclosed which may comprise: an automated sheet stack binding station; a sheet stack transfer mechanism adapted to seize a stack of sheets and to transfer the stack of sheets from the accumulation tray to the automated sheet stack binding station and to hold the stack of sheets in a binding position at the automated sheet stack binding station during a binding operation; a sheet stack binding strip supply mechanism containing a plurality of sheet stack binding strips; a sheet stack binding strip transfer mechanism adapted to transfer one of the sheet stack binding strips from the sheet stack binding strip supply mechanism to the automated sheet stack binding station; the automated sheet stack binding station further comprising an automated sheet stack binding mechanism adapted to attach the binding strip to an edge of the stack of sheets and adjacent portions of a top and a bottom sheet contained in the stack of sheets. The binding strip may comprises a generally flat binding strip having a thermally setting adhesive, a pressure setting adhesive, or both, and the automated sheet stack binding mechanism may further comprise a heating element adapted to apply heat to the thermally setting adhesive.

48 Claims, 8 Drawing Sheets

IMAGE PROCESSING MACHINE HAVING A POST-PROCESSING AUTOMATED SHEET STACK BINDING SYSTEM

FIELD OF THE INVENTION

The present invention relates to the field of image processing machines, e.g., printers and copiers, having post processing of stacks of sheets organized, e.g., into booklets, and including an automated binding mechanism for binding the stack of sheets with a binding strip.

BACKGROUND OF THE INVENTION

It is well known to have post processing finishing stations in image processing machines an example showing the accumulation of sets of sheets for binding or stapling on devices which finish the sets of sheets and then moving the sheets to a stacker or receiver is shown in, e.g., U.S. Pat. No. 6,293,543, entitled UNIVERSAL SHEET RECEIVER FOR STACKERS, issued on Sep. 25, 2000, to the inventor in the present case, (the disclosure of which is hereby incorporated by reference).

U.S. Pat. No. 6,330,999 B2, issued to Coombs, et al, on Dec. 18, 2001, entitled SET BINDING, STAPLING AND STACKING APPARATUS, and owned by the assignee of the present application discloses a stacker with which are associated a binding station and a stapling station. The patent, the disclosure of which is hereby incorporated by reference, discloses:

More particularly, the apparatus is contemplated to automatically apply binding strips in a binding station at which heat and pressure are automatically applied to the binding strips to adhesively secure the sheets in an integrated set, . . . and still further, the finally treated set is discharged vertically to a vertically adjustable stacker tray adapted to receive the desired number of sets. (Col. 1, line 64—Col. 2, line 6) . . .

FIG. 9 is a detail view showing operating means for allowing and causing clamping of a sheet set in a binding strip supplied to the heater and in a normal "HOME" position of the operating means allowing the supply of sheets; (Col. 2, lines 53–57) . . .

Referring first to FIG. 1, the apparatus includes . . . finishing station S2 located above a stacker station assembly S3.

The finishing station S1, as herein shown, includes an automatic thermal strip binding means B . . . (Col. 3, lines 3–8) . . .

[The machine will] move the jogged sheets in a direction down the inclined tray T1, as seen in FIG. 3, into the thermal binding mechanism (Col 4, lines 18–19) . . .

At the binder B, the shelf . . . is incorporated in the thermal binding device, and is moved upon completion of a binding operation . . .

Referring to FIG. 5 it will be seen that the binding means includes a lower heating element . . . , which constitutes, together with other structures, the shelf for the trailing edge of the set and the lower heater is allowed to move downwardly from beneath the trailing edge of the set following completion of the binding operation.

Means are provided at binder B to successively provide binding strips to the lower heater element, clamp the trailing edges of successive sheets forming the set, move an upper heater element into engagement with a portion of the binding strip and deform the binding strip toward the lower heater element. Following completion of a bind, the bound set is released for downward movement by downward swinging movement of the lower heater-shelf when the tray parts of tray T1 are moved to the "DROP" position.

As best seen in FIGS. 1, 2, 5 and 6, the thermal binding means B includes a cartridge 50 for receiving a stack of binding strips 51 biased by a spring 52 upwardly towards an open upper end of the cartridge. At this open upper end, the strips which, in the illustrated embodiment, are right angular in shape, are engaged by transfer means, including a horizontally extended vacuum tube 53 having suction ports for attraction of an upwardly extended side of the uppermost strip. Tube 53 is mounted for horizontal movement between a first position shown in full lines in FIGS. 2, 5 and 6, to a second position shown in broken lines in FIGS. 5 and 6 by suitable guides 54. Actuator means include a motor M8 and a crank arm 55 pinned to the slide at 56 to reciprocate the slide between said first and second positions. The tube 53 is evacuated by a suitable suction pump and motor M9 (FIG. 1) and tube 57.

When in the full line position, tube 53 attracts the strip 51 to remove one strip from magazine 50, while upon removal of one strip, the next upper strip is held against movement by retard means such as a velcro-like strip 58, best seen in FIG. 5.

Upon movement of vacuum tube 53 to the broken line position and engagement of the ends of the strip with stops 59, the strip is released from the tube 53 and drops onto a right angular seat, as indicated by the arrows in FIG. 5, provided by the two part heater means 60.

The two part heater designated 60 in FIG. 5, includes a lower heater 61 extended horizontally at the lower end of receiver tray T1. As previously described, this lower heater provides part of the shelf member to support the lower edge of a set of sheets in tray T1 extending at an incline substantially aligned with tray T1. Also, the lower heater-shelf 61 has an end wall or back stop 63 against which the edges of the sheets are urged for engagement of the strip 51 between the sheet edge and wall 63.

The other heater part 64, as seen in FIGS. 5,7,8 and 8a is adapted to swing downwardly and ultimately in parallel relation to the lower heater element 61, for folding and finally clamping the binding strip 51 against the opposing outer sides of the edges of the set and, in conjuntion with heater element 61, for thermally melting adhesive provided on the binding strip, as customary, and applying pressure for a suitable period to establish the bond following cooling. . . .

As seen in FIGS. 11 and 12, the lower heater support 68 is adapted to swing downwardly from the position of FIG. 11 to the position of FIG. 12 so as to release the bound end of the set for downward movement following the binding operation.

However, during the binding operations, as will be seen by reference to FIGS. 7 through 11, means are provided for controlling the movement of the upper heater 64 and the downward swinging of the lower heater 61.

The means for operating and causing control of the operation of the two just mentioned movements of the upper heater into engagement with the set of sheets and the downward swinging movement of the lower heater to release the set from the binder, include a cam 70 best seen in FIGS. 8, 8*a* and 9 and a rotary member 71 which carries an upper heater support 72. . . .

As previously indicated, a pressure plate is provided and extends transversely of the apparatus to press the leading edge of the set of sheets into the binding 51. As seen specifically in full lines in FIG. 7, the pressure plate is designated 80 and is mounted for sliding downward movement on posts 81 at opposite ends of the apparatus under the influence of a coiled compression spring 82 at each end thereof. (Col. 5, line 22–Col. 7, line 26)

It is also well known to utilize binding strips in desk top publishing applications with binding machines that automatically adhere the binding strip to a stack of sheets to be so bound, wherein the sheets are manually inserted as a stack and a single binding strip is also inserted into the machine. Such machines are shown in the U.S. Pat. No. 6,155,763, entitled BOOKBINDING SYSTEM AND METHOD, issued to Parker, et al. on Dec. 5, 2000; U.S. Pat. No. 5,536,044, entitled HOT MELT ADHESIVE BOUND BOOK, issued to Luhman, et al. on Jul. 16, 1996; U.S. Pat. No. 5,613,711, entitled ADHESIVE BINDING STRIP HAVING TAPERED HIGH TACK ADHESIVE BANDS, issued to Parker on Mar. 25, 1997; U.S. Pat. No. 5,829,938, entitled DESKTOP BOOK BINDER HAVING MEANS FOR ALIGNING SHEETS TO BE BOUND WITH A PREFORMED BINDING MATERIAL AND METHOD, issued to Hartwig, et al. on Nov. 3, 1998; U.S. Pat. No. 6,155,763, entitled BOOKBINDING SYSTEM AND METHOD, issued to Parker, et al. on Dec. 5, 2000; and U.S. Pat. No. 6,402,450, entitled BOOK BINDING, issued to Kritzinger on Jun. 11, 2002, the disclosures of each of which is hereby incorporated by reference.

Also operating and service manuals for Powis-Parker FastBack Model 11 desktop binders, the disclosures of which are hereby incorporated by reference, show similar machines.

SUMMARY OF THE INVENTION

In an image processing machine, having a housing, and including, within the housing, at least one sheet stack accumulation station at which a stack of sheets having been operated on by the image processing machine are accumulated, and a method and apparatus for automated post processing sheet stack binding is disclosed which may comprise: an automated sheet stack binding station; a sheet stack transfer mechanism adapted to seize a stack of sheets and to transfer the stack of sheets from the accumulation tray to the automated sheet stack binding station and to hold the stack of sheets in a binding position at the automated sheet stack binding station during a binding operation; a sheet stack binding strip supply mechanism containing a plurality of sheet stack binding strips; a sheet stack binding strip transfer mechanism adapted to transfer one of the sheet stack binding strips from the sheet stack binding strip supply mechanism to the automated sheet stack binding station; the automated sheet stack binding station further comprising an automated sheet stack binding mechanism adapted to attach the binding strip to an edge of the stack of sheets and adjacent portions of a top and a bottom sheet contained in the stack of sheets. The binding strip may comprises a generally flat thermally setting, pressure setting adhesive, or both, and the automated sheet stack binding mechanism may further comprise a heating element adapted to apply heat to the thermally setting adhesive.

DETAILED DESCRIPTION OF THE PREFERRED EMBODIMENT

Figure 1:
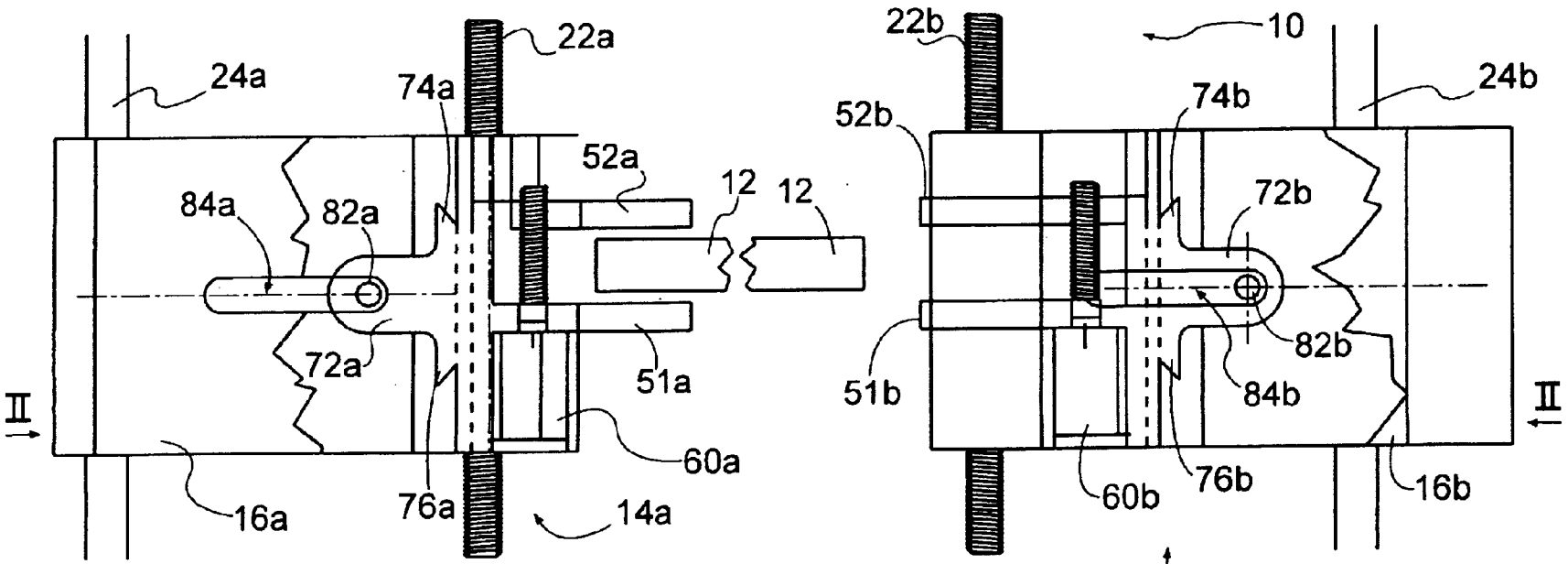
FIG. 1 shows a top view of an automated sheet binding system set of transfer mechanisms according to an embodiment of the present invention.
Figure 2:
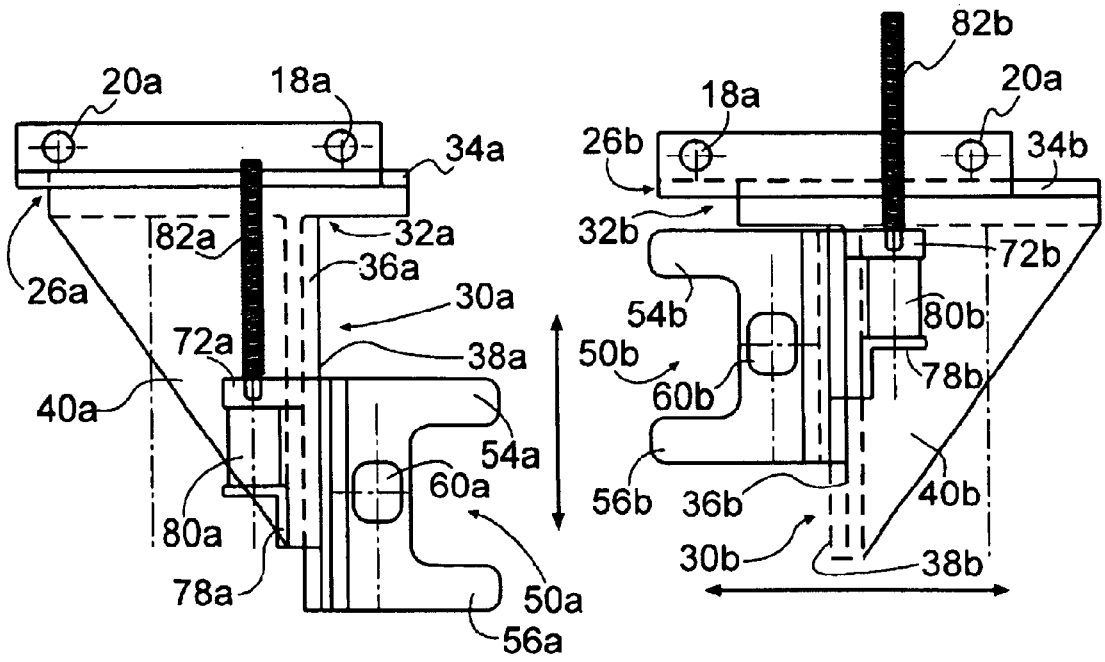
FIG. 2 shows a side view of the pair of transfer mechanisms shown from the direction of the lines II in FIG. 1.

Turning no to FIGS. 1 and 2 there is shown a automated sheet binding system 10 according to an embodiment of the present invention for automatically binding a set of sheets 12 forming a stack which has been accumulated, e.g., in an accumulating tray 48 within the housing (not shown) of an image producing device (not shown), e.g., a copier, printer, FAX machine, scanner or the like, as are well known in the art of image producing machines. The automated sheet binding system 10 may have, e.g., a pair of transfer mechanisms 14*a,* 14*b*. Each of the transfer mechanisms 14*a,* 14*b* can be essentially identical but essentially the mirror image of the other.

Each of the transfer mechanisms 14*a,* 14*b* may have, e.g., a transfer mechanism traveling block 16*a,* 16*b,* which can be, e.g., a generally rectangular block constructed of a suitable material, e.g., rigid plastic or aluminum. Each transfer mechanism traveling block 16*a,* 16*b,* has a pair of holes which can include transfer mechanism traveling block threaded passage 18*a,* 18*b* and transfer mechanism traveling block non-threaded passage 20*a,* 20*b*. Each transfer mechanisms 14*a,* 14*b* can also have, e.g., a transfer mechanism traveling screw 22*a,* 22*b,* which is threaded and a transfer mechanism traveling shaft 24*a,* 24*b,* each of which may be, e.g., non-threaded. Each transfer mechanism traveling screw 22*a,* 22*b* passes in threaded engagement through the respective transfer mechanism traveling block threaded passage 18*a,* 18*b* and each transfer mechanism traveling shaft 24*a,* 24*b* passes in non-threaded engagement through the respective transfer mechanism traveling block threaded passage 20*a,* 20*b*. Rotating the respective transfer mechanism traveling screw 22*a,* 22*b,* e.g., with a stepper motor (not shown) will move the respective transfer mechanism traveling block 16*a,* 16*b* as will be further explained below.

Each respective transfer mechanism traveling block 16*a,* 16*b* may have, e.g., a transfer mechanism traveling block groove 26*a,* 26*b,* which may be, e.g., beveled. Mounted in sliding engagement in the transfer mechanism traveling block groove 26*a,* 26*b* may be, e.g., a transfer mechanism T-bracket in and out sliding member tongue 34*a,* 34*b,* associated with a transfer mechanism T-bracket in and out sliding member 32*a,* 32*b,* which may be, e.g., formed as part of a transfer mechanism T-bracket 30*a,* 30*b.* The transfer mechanism T-bracket 30*a,* 30*b* may have, e.g., a T-bracket in and out sliding member front wall 38*a,* 38*b* and a pair of T-bracket in and out sliding member side walls 40*a,* 40*b,* together forming an opening defined by the respective T-bracket in and out sliding member front wall 38*a,* 38*b* and its respective pair of T-bracket in and out sliding member side walls 40*a,* 40*b.*

The respective transfer mechanism T-bracket 30*a,* 30*b* may, e.g., be moved from an out or home position as shown, e.g., on the right side view in FIGS. 1 and 2 to an in or grasping position as shown in the left side views in FIGS. 1 and 2, by a stepper motor (not shown) which may, e.g., be mounted on the under side of the respective transfer mechanism traveling block 16*a,* 16*b* displaced on either side of the respective transfer mechanism traveling block groove 26*a,* 26*b* and including, e.g., a threaded shaft (not shown) attached to the motor (not shown) and having the threaded shaft (not shown) extend through a suitably placed threaded hole (not shown) in the respective T-bracket in and out sliding member front wall 38*a,* 38*b,* as will be well understood by those in the art. This arrangement, by rotating the rotating shaft (not shown) of the motor (not shown) will serve to move the respective T-bracket in and out sliding member front wall 38*a,* 38*b* with respect to the respective transfer mechanism traveling block 16*a,* 16*b* with the respective transfer mechanism T-bracket in and out sliding member tongue 34*a,* 34*b* moving in sliding engagement with the respective transfer mechanism traveling block groove 26*a,* 26*b* from the in or home position of the respective transfer mechanism T-bracket 30*a,* 30*b* to the out or grasping position of the respective transfer mechanism T-bracket 30*a,* 30*b.*

The respective transfer mechanism T-bracket 30*a,* 30*b* may also have, e.g., a respective transfer mechanism T-bracket in and out sliding member up and down groove 36*a,* 36*b* in the outward face of the respective T-bracket in and out sliding member front wall 38*a,* 38*b* which may also be, e.g., beveled.

Each of the respective transfer mechanisms 14*a,* 14*b* may also include, e.g., a respective transfer mechanism gripping unit 50*a,* 50*b.* Each respective transfer mechanism gripping unit 50*a,* 50*b* may have, e.g., a respective transfer mechanism gripping unit stationary element 51*a,* 51*b* and a respective transfer mechanism gripping unit moving element 52*a,* 52*b.* Each respective transfer mechanism gripping unit moving elements 52*a,* 52*b* and transfer mechanism gripping unit stationary element 51*a,* 51*b* may have a pair fingers 54*a,* 54*b* and 56*a,* 56*b.*

Each respective transfer mechanism gripping unit 50*a,* 50*b* may include, e.g., a gripping unit slide member 72*a,* 72*b* which may include a pair of respective gripping unit slide member tongue half 74*a,* 74*b* and gripping unit slide member tongue half 76*a,* 76*b* forming a tongue that is in sliding engagement within the respective transfer mechanism T-bracket in and out sliding member up and down groove 36*a,* 36*b* in the respective T-bracket in and out sliding member front wall 38*a,* 38*b,* and also include a portion of the respective gripping unit slide member 72*a,* 72*b,* which extends through a slot in the respective T-bracket in and out sliding member front wall 38*a,* 38*b* and may include, e.g., a threaded opening for a respective gripping unit slide member up and down motor threaded shaft 82*a,* 82*b,* which in turn may be rotatably attached to a respective gripping unit slide member up and down motor 80*a,* 80*b.* Each respective gripping unit slide member up and down motor 80*a,* 80*b* may be attached to the inward facing side of the respective T-bracket in and out sliding member front wall 38*a,* 38*b* by, e.g., a respective motor mounting bracket 78*a,* 78*b.*

The respective gripping unit slide member up and down motor 80*a,* 80*b* for each respective transfer mechanism gripping unit 50*a,* 50*b* serves to move the respective transfer mechanism gripping unit 50*a,* 50*b* from an or upper position as shown in the right side view of FIGS. 1 and 2 to a lower position as shown in the left side view of FIGS. 1 and 2.

Figure 3:
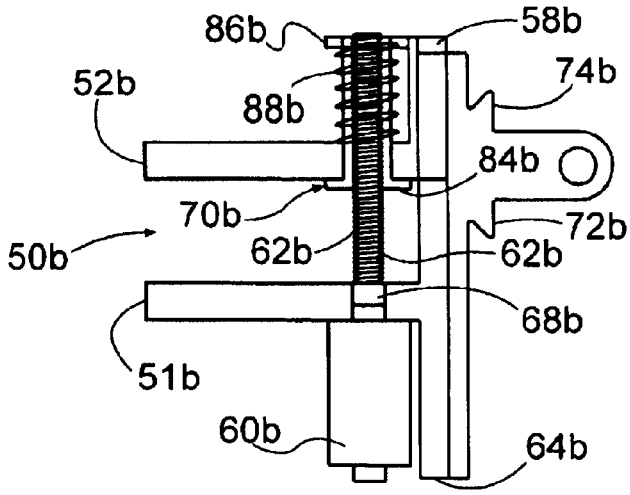
FIG. 3 shows a top view of a transfer mechanism gripping unit according to an embodiment of the present invention.

Turning now to FIG. 3, there is shown in more detail one of the respective transfer mechanism gripping units 50*a,* 50*b.* Each respective transfer mechanism gripping unit 50*a,* 50*b* may have, e.g., a transfer mechanism gripping unit moving element motor 60*a,* 60*b.* The respective transfer mechanism gripping unit moving element motor 60*a,* 60*b* may be mounted to the outside of each respective transfer mechanism gripping unit moving element 52*a,* 52*b* and include, e.g., a respective transfer mechanism gripping unit moving element threaded shaft 62*a,* 62*b,* which may extend through, e.g., a respective gripping unit moving element motor bearing 68*a,* 68*b* in passing through the respective transfer mechanism gripping unit stationary element 51*b,* 51*b.* The respective transfer mechanism gripping unit moving element threaded shaft 62*a,* 62*b* may also be threadably engaged in a respective gripping unit moving element bushing 70*a,* 70*b,* which may, e.g., pass through a respective opening in the respective transfer mechanism gripping unit moving element 52*a,* 52*b.* Each respective gripping unit moving element bushing 70*a,* 70*b* may have, e.g., a respective gripping unit moving element bushing flange 84*a,* 84*b* on the interior side of the respective opening through the respective transfer mechanism gripping unit moving element 52*a,* 52*b* through which the respective gripping unit gripping unit moving element bushing 70*a,* 70*b* extends and a respective gripping unit moving element bushing flange 86*a,* 86*b* on the exterior side of the respective transfer mechanism gripping unit moving element 52*a,* 52*b,* with a respective gripping unit moving element spring 88*a,* 88*b* extending in tension between the outwardly facing side of the respective transfer mechanism gripping unit moving element 52*a,* 52*b* and the respective gripping unit moving element bushing flange 86*a,* 86*b.* The respective gripping unit moving element spring 88*a,* 88*b* in cooperation with the respective transfer mechanism gripping unit moving element 52*a,* 52*b* and the respective gripping unit moving element bushing flange 86*a,* 86*b* serves to allow the stepping motor 60*a,* 60*b* to be set to turn a fixed number of revolutions essentially to the completely closed position where the moving element 52*a,* 52*b* is as close to abutting the stationary element 51*a,* 51*b* as the width of the flange 84 allows (which essentially defines the minimum stack height of a stack of sheets 12 that the gripping unit 50*a,* 50*b* can grip. If no sensors are provided the enable the controller (not shown) to set the number of revolutions, or if the stack is of such a height that it would be difficult for the controller to turn motor 60*a,* 60*b* exactly the right number of revolutions. In either case, once the moving element 52*a,* 52*b* engages the stack of sheets 12, the motor 60*a,* 60*b* can continue to turn and the spring 88*a,* 88*b* absorbs the continuing revolutions while the moving element 52*a,* 52*b* stays in place. The spring pressure of the spring 88*a,* 88*b* also then serves to tighten the grip on the stack of sheets 12. The respective transfer mechanism gripping unit moving element motor 60*a,* 60*b* moves the respective transfer mechanism gripping unit moving element 52*a,* 52*b* by stepping a certain number of revolutions under the control of a controller (not shown), which may be as noted, controlled using the input of a stack thickness sensor(s) (not shown) to variable numbers of revolutions, in which event the spring 88*a,* 88*b* serves to allow the motor to turn an extra revolution or portion thereof to insure the proper positioning of the moving element 52*a,* 52*b* and the application of spring pressure to the stack 12, or by a single fixed number of revolutions each time activated by the controller (not shown) in the event, e.g., that there is no stack thickness sensor(s) (not shown).

In operation it will be understood that the respective transfer mechanism gripping unit moving element 52*a,* 52 can, e.g., be moved by the respective transfer mechanism gripping unit moving element motor 60*a,* 60*b* to grip between the respective transfer mechanism gripping unit stationary element 51*a,* 51*b* and the respective transfer mechanism gripping unit moving element 52*a,* 52*b* a stack of sheets as more fully described below.

Figure 4:
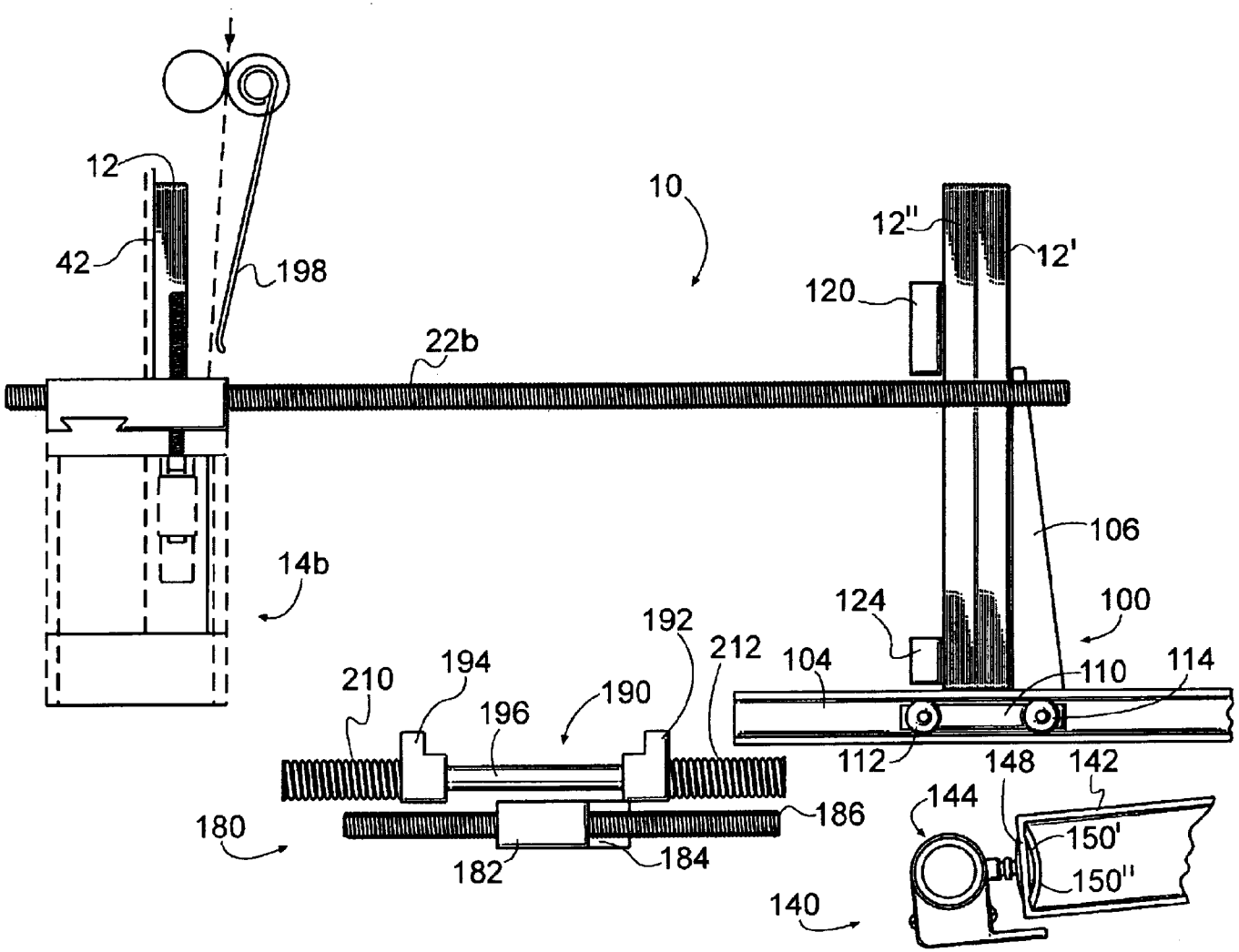
FIG. 4 shows side view of an overall automated sheet binding system according to an embodiment of the present invention.

Turning now to FIG. 4 there is shown a side view of an overall automated sheet binding system 10 according to an embodiment of the present invention. The overall automated sheet binding system 10 includes, e.g., a sheet stack transfer mechanism comprising, e.g., the respective pair of transfer mechanisms 14*a,* 14*b,* a finished booklet stacker 100, a binding strip storage and transfer mechanism 140, and a binding strip automatic binding mechanism 180.

The finished booklet stacker 100 may include, e.g., pair of finished booklet stacker linear slides 102 (only one of which is shown), illustrated with its side facing the viewer removed, each having a finished booklet stacker linear slide channel 104 in which are contained for rolling translation within the finished booklet stacker linear slide 102 a finished booklet stacker linear slide channel slide member 110 (only one of which is shown). The respective finished booklet stacker linear slide channel slide member 110 may include, e.g., a finished booklet stacker linear slide channel slide member front wheel 112 and a finished booklet stacker linear slide channel slide member rear wheel 114 each rotatably mounted on the respective finished booklet stacker linear slide channel slide member 110. The finished booklet stacker linear slide channel slide member 110 may be, e.g., attached to or form a part of a bound sheet stack storage stacker 106.

The finished booklet stacker 100 may also include, e.g., a finished booklet stacker top holding plate 120 and a finished booklet stacker bottom holding plate 124 which can serve to hold a plurality of sets of bound sheets 12' and 12" after they have been bound and delivered to the finished booklet stacker 100 by the transfer mechanisms 14*a,* 14*b.*

Figure 5:
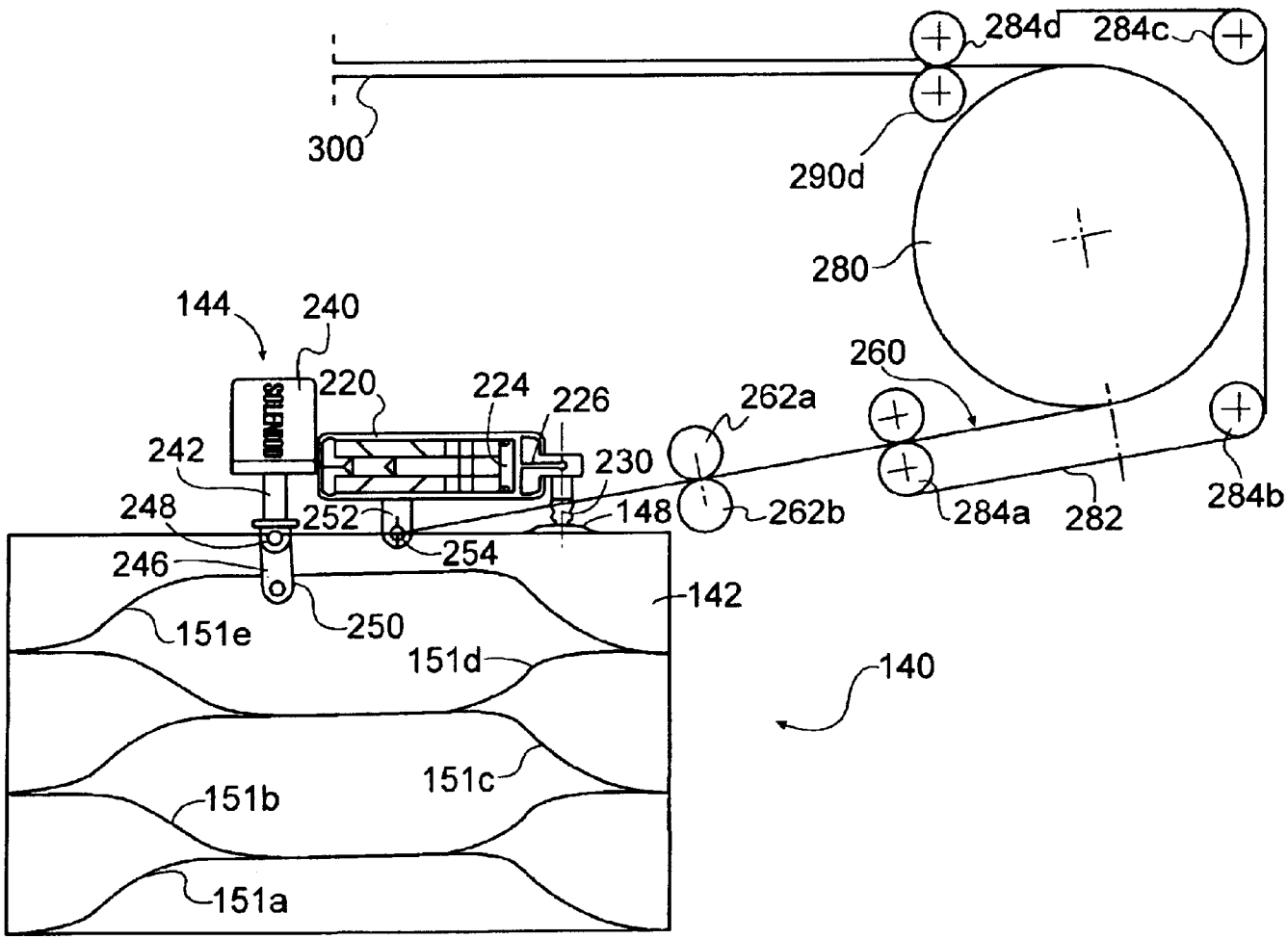
FIG. 5 shows a top view of a binding strip transfer mechanism according to an embodiment of the present invention, which is partially schematic.

The binding strip storage and transfer mechanism 140 may include, e.g., a binding strip feeder magazine 142, which may contain a plurality of binding strip binding strip 150, with the top two 150' and 150" only illustrated within the binding strip feeder magazine 142 in FIG. 4. Each binding strip 150 in its turn may be removed from the binding strip feeder magazine 142 by a binding strip transfer mechanism suction grabber 148 connected to the binding strip transfer mechanism binding strip transfer mechanism 144, as more fully described below. Each binding strip 150 as illustrated, e.g., in FIG. 4, may be generally flat, but with a slightly curved shape to facilitate placement in and manipulation by the binding strip automatic binding mechanism 180 as more fully described below. As shown in FIG. 5, each binding strip 150 in the binding strip feeder magazine 142 is biased towards the opening end of the binding strip feeder magazine 142 by a spring 151, e.g., an accordion spring having a plurality of binding strip magazine spring leaves 151*a–e.*

It will be understood, that generally flat as used in this application means that the elongated binding strip 150 is not pre-folded in storage or in transport or as delivered to the binding strip automatic binding mechanism binding strip automatic binding mechanism 180, though it may, as illustrated be slightly concave (or convex) and may be pre-scored and/or otherwise have gaps in the adhesive placed on the binding strip 150, as is well known in the art. The desire is to have the binding strip 150 as automatically placed, as is more fully described below, extend up each side, i.e., on the front sheet and back sheet of a set of sheets 12 once bound essentially evenly, i.e., for essentially the same distance.

The binding strip automatic binding mechanism 180 may include, e.g., a binding strip automatic binding mechanism seal bar traveler 182 which may be, e.g. threadedly mounted on a binding strip automatic binding mechanism seal bar traveler threaded shaft 186 for movement along the binding strip automatic binding mechanism seal bar traveler threaded shaft 186 when the binding strip automatic binding mechanism seal bar traveler threaded shaft 186 is rotated, e.g., by a stepper motor (not shown) under the control of a controller (not shown). The binding strip automatic binding mechanism seal bar traveler 182 may be, e.g., an elongated bar extending generally under the stack of sheets 12 when the set of sheets 12 is at the binding strip automatic binding mechanism 180. The binding strip automatic binding mechanism 180 may also have an opening generally at its other end from that shown in FIG. 4, through which may pass, e.g., a non-threaded shaft (not shown) to hold the binding strip automatic binding mechanism 180 in place in relation to the set of sheets 12 while moving along the binding strip automatic binding mechanism seal bar traveler threaded shaft 186.

The binding strip automatic binding mechanism 180 may have attached to it, e.g., a binding strip automatic binding mechanism seal bar 184, which may e.g., extend generally the length of the binding strip automatic binding mechanism seal bar traveler 182 and be attached to the binding strip automatic binding mechanism seal bar traveler 182 for pivotal movement, as further explained below, under the control of a controller (not shown) and a pivoting device (not shown) also as more fully described below.

The binding strip automatic binding mechanism 180 may also have, e.g., a binding strip automatic binding mechanism backing unit 190 which may include, e.g., a binding strip automatic binding mechanism backing unit rear backing plate 192 and a binding strip automatic binding mechanism backing unit front backing plate 194 each of which may be mounted for sliding motion along a binding strip automatic binding mechanism backing unit backing plate guide shaft. Attached to each of the binding strip automatic binding mechanism backing unit rear backing plate 192 and binding strip automatic binding mechanism backing unit front backing plate 194 may be, respectively, a binding strip automatic binding mechanism backing unit rear backing plate spring 212 and a binding strip automatic binding mechanism backing unit front backing plate spring 210.

Turning now to FIG. 5 there is shown in more detail other elements of the binding strip transfer mechanism 144 which are shown partially schematically. The binding strip transfer mechanism 144 may include, e.g., a binding strip grabber piston cylinder 220 within which may be, e.g., a binding strip grabber piston 224 with the internal portion of the binding strip grabber piston cylinder 220 containing the binding strip grabber piston cylinder 220 having, e.g., a binding strip grabber suction passage 226 in fluid communication with the binding strip transfer mechanism suction grabber 148 through a flexible binding strip suction grabber bellows 230. The binding strip grabber piston 224 may be operated by a binding strip grabber solenoid 240. The binding strip grabber solenoid 240 may be hingedly connected to a portion (not shown) of the image producing machine (not shown) post processing machine (not shown) by a binding strip grabber solenoid pivot mount 242, which may, e.g., be connected to a binding strip grabber solenoid pivot mount 246 by a pivot pin 248, with, e.g., the binding strip grabber solenoid pivot mount 246 connected to the portion of the post processing machine (not shown) by a pivot pin pivot pin 250. The pivot pin 250 may be connected to, e.g., a stepper motor (not shown) or other suitable rotating device (not shown) to effect pivoting of the binding strip grabber solenoid pivot mount 246. The binding strip grabber piston cylinder 220 may, e.g., be pivotally mounted to a portion (not shown) of the image producing machine (not shown) post processing machine (not shown) by a piston cylinder mount 252 which may be mounted on a piston cylinder mount pivot pin 254 attached to the a portion (not shown) of the image producing machine (not shown) post processing machine (not shown).

In operation, the binding strip transfer mechanism suction grabber 148 may be positioned, e.g., generally as shown in FIG. 5 and the binding strip grabber solenoid 240 activated by a controller (not shown) to move the binding strip grabber piston 224 to, e.g., draw a vacuum in the interior of the binding strip grabber piston cylinder binding strip grabber piston cylinder 220, which is translated through the binding strip grabber suction passage 226 and the binding strip suction grabber bellows 230 to the binding strip transfer mechanism suction grabber 148, which in turn can cause, e.g., the binding strip transfer mechanism suction grabber 148 to become attached to the top-most binding strip 150' in the binding strip feeder magazine 142 and to grab or seize hold of that binding strip binding strip 150'.

The binding strip grabber piston cylinder 220 may then, e.g., be rotated in the counterclockwise direction as shown in FIG. 5 by the rotation of the pivot pin 250, e.g., by a stepper motor (not shown) in order to present an end of a binding strip 150 held by the binding strip transfer mechanism suction grabber 148 to a pair of binding strip delivery mechanism delivery path input rollers 262*a,* 262*b,* at least one of which may be driven by a motor under the control of a controller (not shown). The binding strip delivery mechanism delivery path input rollers 262*a,* 262*b* can, e.g., feed the binding strip 150, e.g., to a binding strip 150 delivery unit which may include, e.g., a binding strip delivery mechanism drive roller 280 and a binding strip delivery mechanism drive belt 282 along with associated binding strip delivery mechanism drive rollers 284*a–d* and a pair of binding strip delivery mechanism guide rollers 290*a,* 290*b.* The binding strip delivery mechanism delivery path input rollers 262*a,* 262*b,* the binding strip delivery mechanism drive roller binding strip delivery mechanism drive roller 280, and binding strip delivery mechanism drive rollers 284*a–d* define a binding strip delivery mechanism delivery path 260 from, e.g., the binding strip transfer mechanism 144 to the binding strip automatic binding mechanism 180.

It will be understood by those skilled in the art that the binding strip transfer mechanism 144, as above described may be mounted on a moveable portion (not shown) of the image producing machine, which may be moveable under the control of a controller (not shown) once the binding strip 150 is grabbed by the suction grabber 148 to move the unit toward the binding strip delivery mechanism delivery path input rollers 262*a,* 262*b* to enable engagement of the binding strip 150 by the binding strip delivery mechanism delivery path input rollers 262*a,* 262*b,* or alternatively, e.g., the binding strip delivery mechanism delivery path input rollers 262*a,* 262*b* may be moveable under the control of a controller (not shown) to move toward the grabbed binding strip 150 to grip the binding strip in the binding strip delivery mechanism delivery path input rollers 262*a,* 262*b,* or both such units may be moveable to effect the exchange of the binding strip 150 from the suction gripper 148 to the binding strip delivery mechanism delivery path input rollers 262*a,* 262*b.* It will also be understood that the engagement of the binding strip by the binding strip delivery mechanism delivery path input rollers 262*a,* 262*b,* may be sufficient to release the binding strip from the suction grabber 148 and/or the controller (not shown) may cause the piston 224 to move forward to eliminate or significantly enough reduce the vacuum grip to release the binding strip 150 from the suction grabber 148.

The binding strip delivery mechanism delivery path input rollers 262*a,* 262*b* feed the binding strip 150 to the rollers 290*a,* 284*a* which in turn feed the binding strip 150 along the portion of the binding strip delivery mechanism drive belt 282 between the rollers 290*a* and 284*a* to the binding strip delivery mechanism drive roller 280 where the binding strip 150 is held between the binding strip delivery mechanism drive roller 280 and the binding strip delivery mechanism drive belt 282 to pass around the binding strip delivery mechanism drive roller 280 to the portion of the binding strip delivery mechanism drive belt 282 between the binding strip delivery mechanism drive roller 280 and the rollers 290*b* and 284*d,* which then, e.g., feed the binding strip 150 into a receiver, e.g., an automatic binding mechanism binding strip receiving trough 300 at the binding strip automatic binding mechanism binding strip automatic binding mechanism binding strip automatic binding mechanism 180. The automatic binding mechanism binding strip receiving trough 300 serves to hold the binding strip 150 in place for the initiation of the action by the binding strip automatic binding mechanism 180 as more fully explained below, and then may be moved out of the way by a suitable moving mechanism (not shown) under the control of a controller (not shown). The binding strip delivery mechanism drive roller 280 may also be driven by a motor (not shown) under the control of a controller (not shown), which can also serve to rotate the binding strip delivery mechanism drive belt 282 on the binding strip delivery mechanism drive rollers 284*a–d* and consequently also the binding strip delivery mechanism guide rollers 290*a,* 290*b.*

Figure 6A:
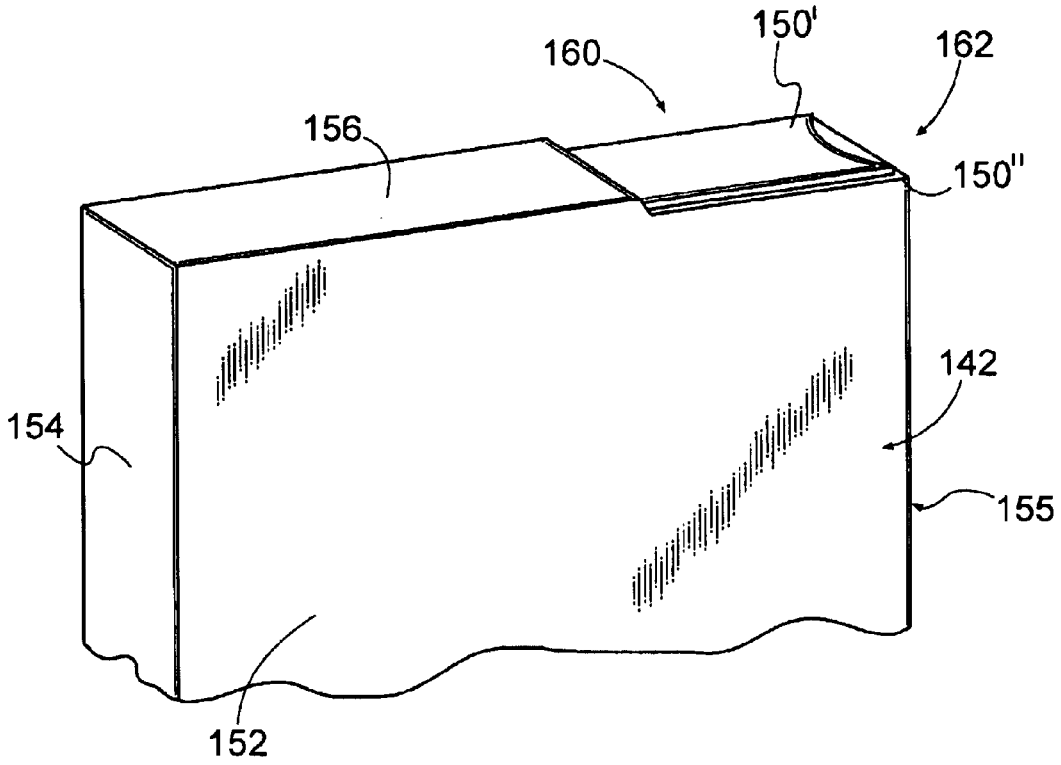
FIGS. 6*a* and 6*b* show more detailed views of embodiments of the binding strip feeder magazine according to an embodiment of the present invention.

Turning now to FIG. 6*a,* a more detailed view of the binding strip feeder magazine 142 according to an embodiment of the present invention is shown. The binding strip feeder magazine 142 may have, e.g., a pair of magazine front and back walls 152 and a magazine side wall 154 and an opposing magazine side wall magazine side wall 155, along with a magazine top wall magazine top wall 156. The magazine top wall 156 may have, e.g., a magazine top notch 160 that is positioned and shaped to allow the binding strip transfer mechanism suction grabber 148 access to the top-most binding strip binding strip 150' overlying a next most binding strip 150". The magazine side wall 155 may also be shortened slightly by a magazine side wall cut 162 to, e.g., remain in contact with the end of the binding strip 150", while not blocking the movement of the binding strip 150' toward the right hand side of the view of the binding strip feeder magazine 142 shown in FIG. 6, thereby facilitating the lifting of the binding strip 150' by the binding strip transfer mechanism suction grabber 148 and movement of the binding strip 50' by the binding strip storage and delivery mechanism 140 to the binding strip delivery mechanism delivery path input rollers 262*a,* 262*b*. It will be seen, that engagement of the binding strip 150' by the binding strip delivery mechanism delivery path input rollers 262*a,* 262*b* may, e.g., further serve to draw the binding strip 150' out of the binding strip feeder magazine 142 and into the delivery mechanism, while the binding strip 150" may, e.g., be prevented by the magazine side wall 155 from moving to the right in the view shown in FIG. 6, e.g., due to the frictional engagement of the binding strip 150' and the binding strip 150" as the binding strip 150' is drawn out of the binding strip feeder magazine 142 and into the delivery mechanism.

Figure 6B:
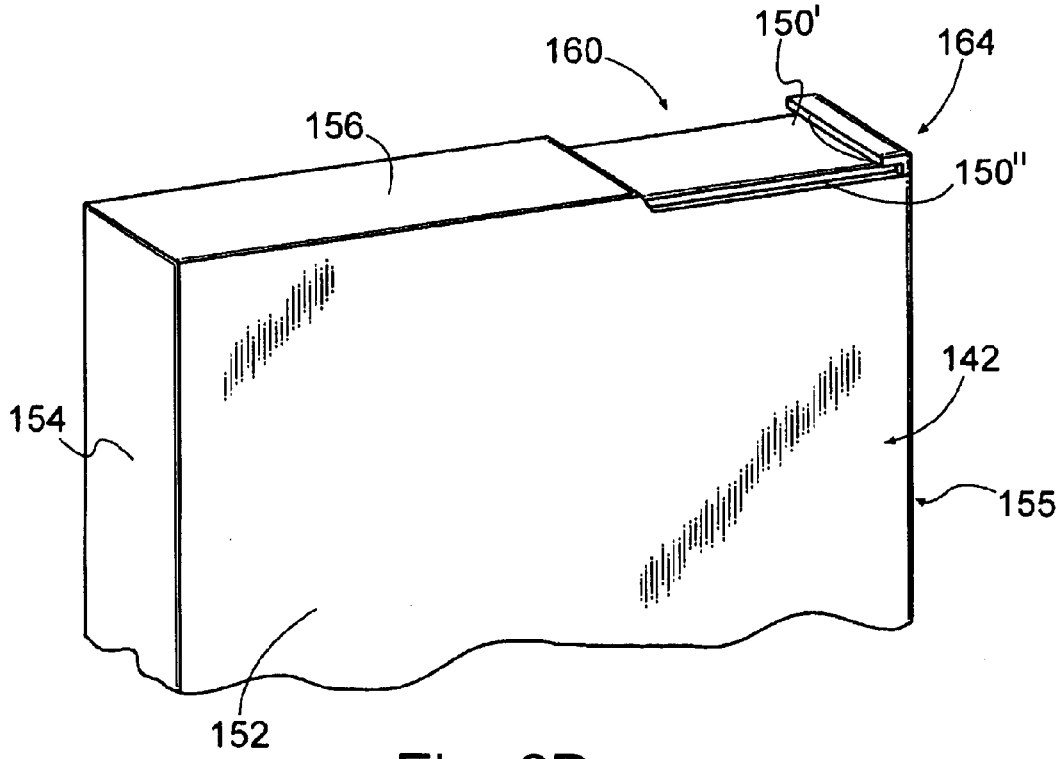

Turning now to FIG. 6*b* there is shown an alternative embodiment for the binding strip feeder magazine. In the embodiment of FIG. 6*b* the magazine side wall 155 may be formed with a magazine side wall lip 164 to, e.g., be in contact with the end of the binding strip 150', before the binding strip 150' is grabbed by the suction grabber 148. Once the binding strip, in this embodiment of FIG. 6*b,* is grabbed by the suction grabber 148, and the suction grabber 148 is moved to withdraw the binding strip 148 from the magazine 142, as described above, the binding strip 150' will pop past the lip 164 and the lip 164 will then engage the end of the binding strip 150" and prevent the binding strip 150 from moving further upward under the force of the spring 152 or to the right as shown in FIG. 6*b,* until the suction grabber 148 is caused to grab the binding strip 150" for withdrawal from the magazine 142.

Turning now to FIGS. 7–12, there is shown the operation of the binding strip automatic binding mechanism 180 including the binding strip automatic binding mechanism backing unit 190, according to an embodiment of the present invention. The binding strip 150 has been delivered to the binding strip automatic binding mechanism 180 by the binding strip storage and delivery mechanism 140 into a automatic binding mechanism binding strip receiving trough 300 positioned adjacent to the binding strip automatic binding mechanism 180 in a location ready for insertion of the binding strip 150 into the binding strip automatic binding mechanism 180.

In addition the set of sheets 12 has been moved from the location of the accumulation tray 42 by the action of the respective transfer mechanisms 14*a,* 14*b* moving inward from the home position shown in the right half views of FIGS. 1 and 2 to the set of sheets 12 engaging position shown at the left hand view of FIG. 1, by the action of the respective motors (not shown) moving the respective transfer mechanism T-bracket in and out sliding member 32*a,* 32*b* within the respective transfer mechanism traveling block groove 26*a,* 26*b* with the respective transfer mechanism traveling block 16*a,* 16*b* laterally displaced at the accumulation tray 42 location.

It will be understood that various guides and joggers, e.g., the flapper arm 198, may be employed to guide the arriving sheets from the image processing machine (not shown) into the accumulation tray 42 in the relationship of a set of sheets 12 which is ready for binding if moved to the binding strip automatic binding mechanism 180, i.e., the sheets in the set of sheets 12 are appropriately aligned. It will also be understood that various mechanisms exist to insert, e.g., a front or a back cover, or both, to the set of sheets 12 as part of the post processing stacking, collating and binding process as is well known, and such covers and the like are to be considered within the scope of the meaning of a set of sheets 12. It will also be understood by those skilled in the art, that the accumulation tray 42 may have appropriate cut-outs or the like in it side wall(s) as appropriate to allow the respective fingers 54*a,* 54*b* and 56*a,* 56*b* access to grip the set of sheets 12 in the position as shown in the left side view of FIG. 1, by the movement of the transfer mechanism T-bracket 30*a,* 30*b* just described and by the operation of the respective transfer mechanism gripping unit moving element motor 60*a,* 60*b* along with the effect of the respective gripping unit moving element spring 88*a,* 88*b*. It will also be understood by those skilled in the art that the two respective transfer mechanisms 14*a,* 14*b* may be substituted for by other suitable gripping and translating mechanisms for transferring the set of sheets 12 from the accumulation tray 42 to the binding strip automatic binding mechanism 180, including, e.g., only a single one of the respective transfer mechanisms 14*a,* 14*b,* which may be, e.g., the transfer mechanism 14*b*.

Figure 7:
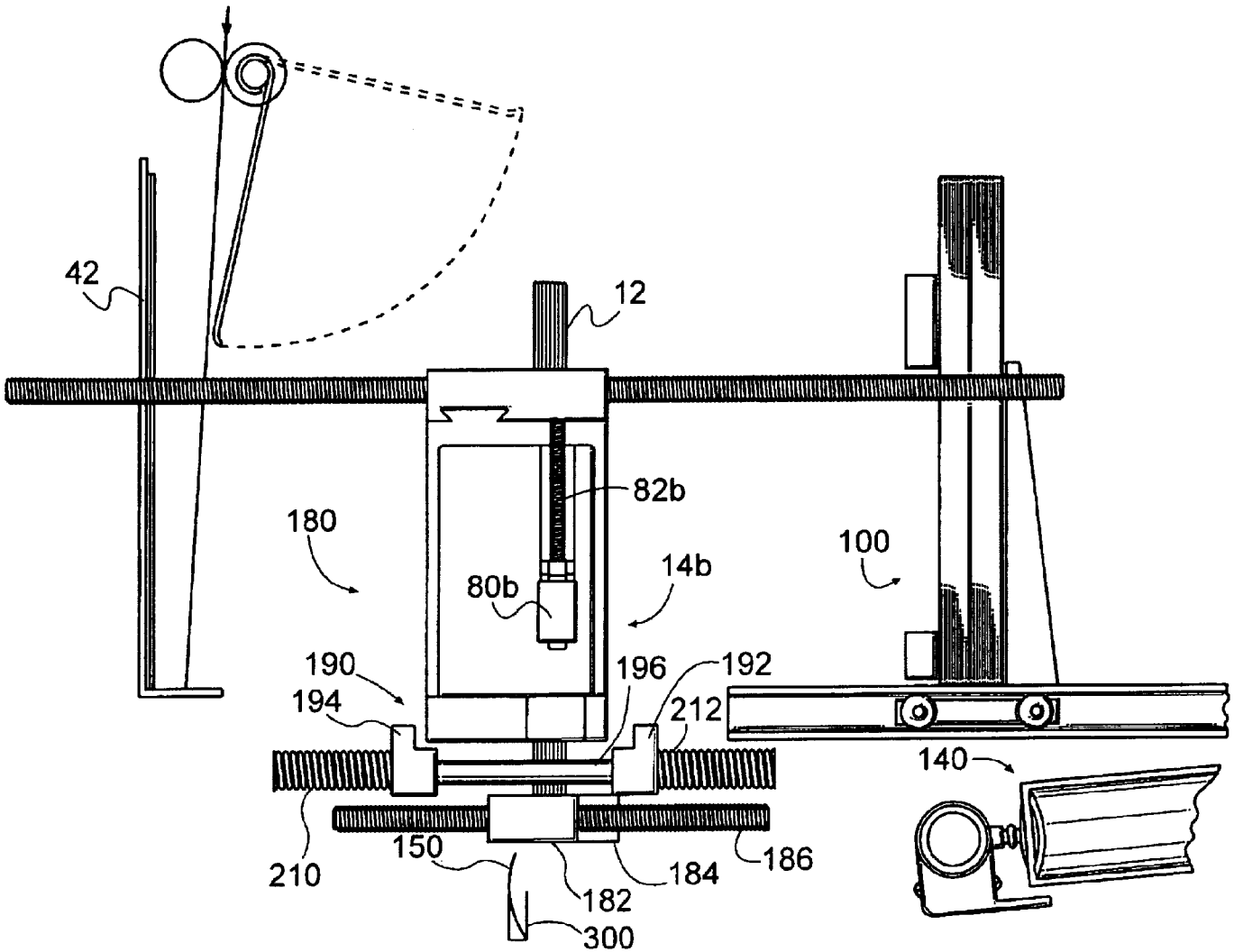
FIG. 7 shows a side view of an embodiment of the present invention with the stack of sheets moved to the automatic binding mechanism and the binding strip moved to the automatic binding mechanism in preparation for the operation of the automatic binding mechanism.

Once the set of sheets 12 has been gripped at the accumulation tray 42, the respective transfer mechanisms 14*a,* 14*b* may be moved laterally to the binding strip automatic binding mechanism 180 station, as shown, e.g., in FIG. 7 and, also as shown in FIG. 7 the respective transfer mechanisms 14*a,* 14*b* may be, e.g., lowered to the position shown, e.g., in the left side view of FIG. 2, such that the bottom edges of the sheets in the set of sheets 12 are abutting the binding strip automatic binding mechanism seal bar traveler 182, as shown in FIG. 7. As shown in FIG. 7 the binding strip automatic binding mechanism backing unit rear backing plate 192 and binding strip automatic binding mechanism backing unit front backing plate 194 of the binding strip automatic binding mechanism backing unit 190 are at this time being held in a position away from the set of sheets 12, e.g., by a suitable holding and retrieving mechanism (not shown) that, under the control of a controller (not shown) is holding the respective binding strip automatic binding mechanism backing unit rear backing plate 192 and binding strip automatic binding mechanism backing unit front backing plate 194 against the spring pressure of the respective binding strip automatic binding mechanism backing unit rear backing plate spring 212 and binding strip automatic binding mechanism backing unit front backing plate spring binding strip automatic binding mechanism backing unit front backing plate spring 210.

Figure 8:
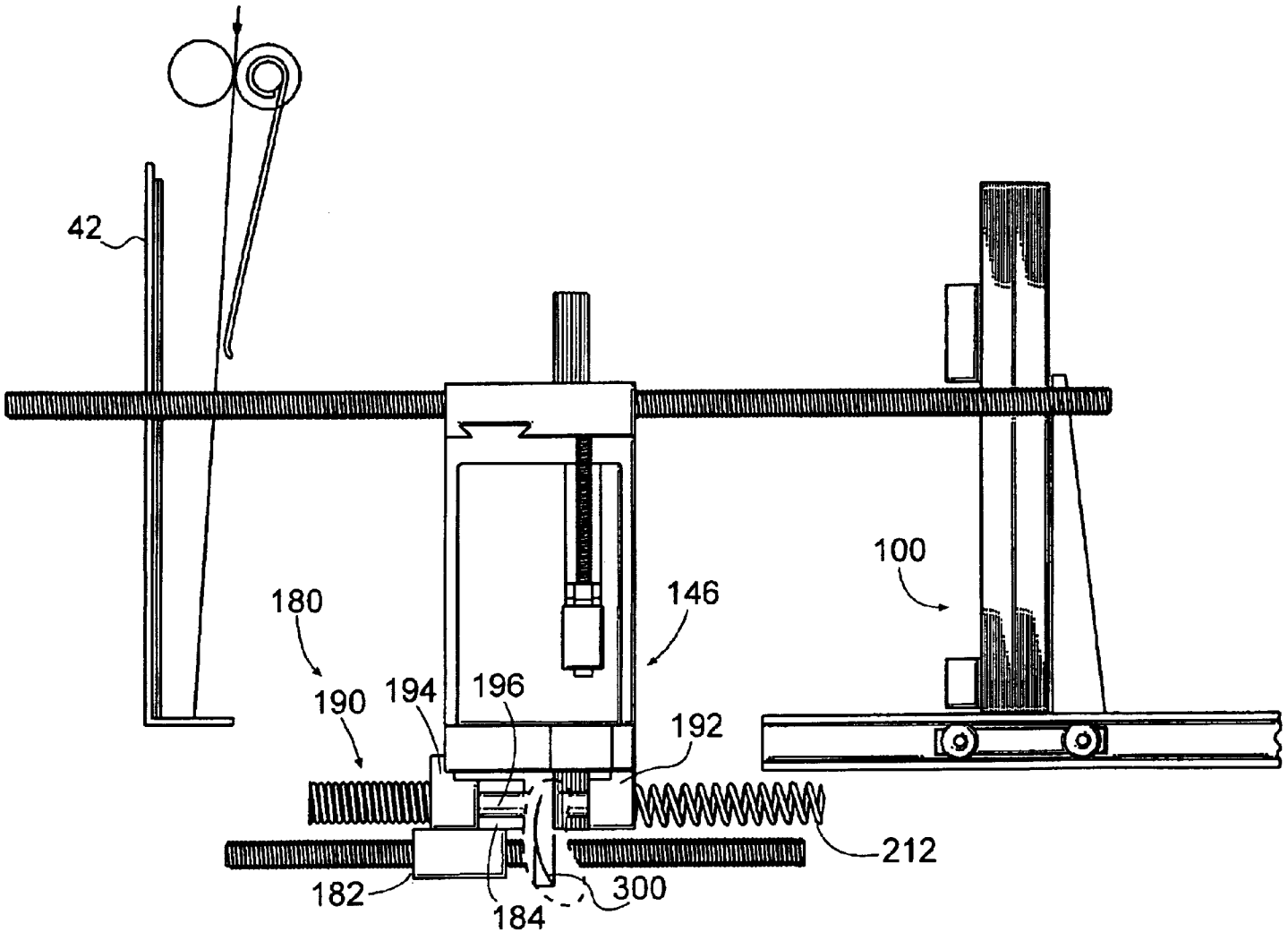
FIG. 8 shows a first step in the operation of the automatic binding mechanism according to an embodiment of the present invention.

Turning to FIG. 8, which is shown partially cut-away, the automatic binding mechanism binding strip receiving trough 300 is moved by a suitable moving mechanism (not shown) under the control of a controller (not shown) to a position where the binding strip 150 is positioned adjacent one side of a lower portion of the set of sheets set of sheets 12, while the binding strip automatic binding mechanism backing unit rear backing plate 192 is released by its holding and retrieving mechanism (not shown) for movement along the binding strip automatic binding mechanism backing unit backing plate guide shaft 196 under the influence of the binding strip automatic binding mechanism backing unit rear backing plate spring 212 into the position shown in FIG. 7 where it is in engagement with the lower end of the set of sheets 12 opposing the side where the binding strip 150 has been inserted adjacent to the set of sheets 12.

It will be further understood that sensors (not shown), e.g., in association with the respective transfer mechanism gripping unit moving element motor 60*a,* 60*b,* and/or the respective transfer mechanism gripping unit 50*a,* 50*b,* may be utilized to provide input to the controller (not shown)

indicative of the width of the width of the grasped set of sheets 12, e.g., across the bottom edge (spine area) as shown in FIGS. 7–12, where the spine of the set of sheets 12 will be bound by the binding strip 150. In this manner, e.g., the controller (not shown) can also serve to select the positioning of the automatic binding 300, such that it extends along the left side of the set of sheets 12 as shown in FIG. 8 to a selected point that will result in the completed binding also having the binding strip 150 extend along the right side of the set of sheets 12 as shown in FIG. 8 essentially for the same length, depending upon the width of the binding strip 150 and the width of the stack of sheets across the spine area (bottom edge as shown in FIG. 8.

In addition, the binding strip automatic binding mechanism seal bar 184, operated by a automatic binding strip seal bar positioning mechanism (not shown) also under the control of a controller (not shown) is swung upwardly from the position shown in FIG. 7 to a position where it is adjacent the side of the portion of the binding strip 150 adjacent the lower end of the set of sheets 12 on the opposite side of the binding strip 150 from the set of sheets 12. The binding strip automatic binding mechanism seal bar traveler 182 has been translated by the rotation of the binding strip automatic binding mechanism seal bar traveler threaded shaft 186 by a stepping motor (not shown) under the control of a controller (not shown) to the position shown in FIG. 8 to allow the binding strip automatic binding mechanism seal bar 184 to be moved into the position of the binding strip automatic binding mechanism seal bar 184 shown in FIG. 8 by its automatic binding strip seal bar positioning mechanism (not shown).

The binding strip automatic binding mechanism seal bar 184 can then be moved by the rotation of the binding strip automatic binding mechanism seal bar traveler threaded shaft 186 by its stepping motor (not shown) under the control of a controller (not shown) to apply pressure to the binding strip 150 against the backing of the binding strip automatic binding mechanism backing unit rear backing plate 192. The binding strip automatic binding mechanism seal bar 184 may also have, e.g., an internal heating element (not shown) for applying heat also to the binding strip 150 for those binding strips 150 that include, e.g., a thermally setting or thermally softening/activating binding strip 150 in order, e.g., to melt the adhesive backing on the binding strip 150 and cause it to then set either with the application of cooling or pressure or both.

Figure 9:
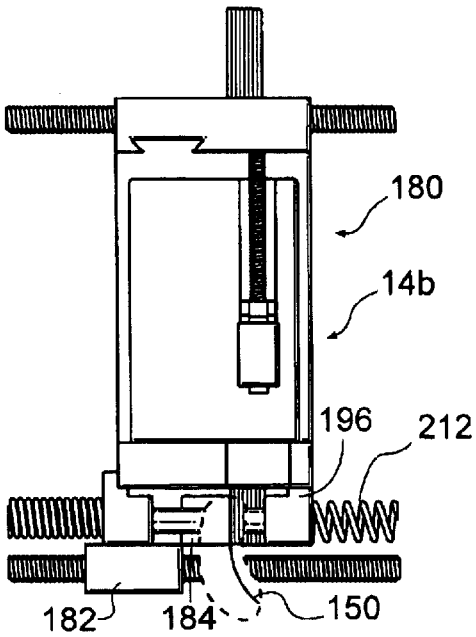
FIGS. 9–12 show subsequent steps in the operation of the automatic binding mechanism according to an embodiment of the present invention.

Turning now to FIG. 9 the binding strip automatic binding mechanism seal bar 184 has been moved by moving the binding strip automatic binding mechanism seal bar traveler 182 along the binding strip automatic binding mechanism seal bar traveler threaded shaft 186 such that the binding strip automatic binding mechanism seal bar 184 is in pressure and heating contact with the portion of the binding strip 150 on the left hand side of the set of sheets 12 as shown in FIG. 9, against the backing of the binding strip automatic binding mechanism backing unit rear backing plate 192 held in place by the binding strip automatic binding mechanism backing unit rear backing plate spring 212. FIG. 9 also shown that the automatic binding mechanism binding strip receiving trough 300 has been moved out of the position shown in FIG. 8 by the automatic binding mechanism binding strip receiving trough 300 moving mechanism (not shown) under the control of a controller (not shown).

Figure 10:
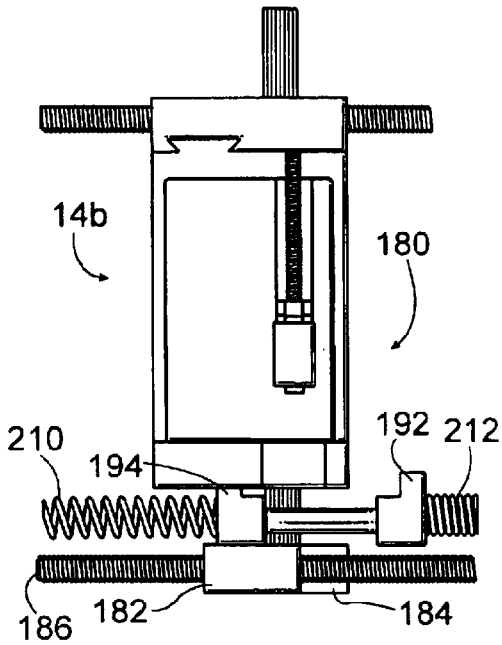

Turning now to FIG. 10, the binding strip automatic binding mechanism seal bar 184, after being moved laterally with the binding strip automatic binding mechanism seal bar traveler 182 by the action of its stepping motor (not shown) under the control of the controller (not shown) sufficiently to allow the binding strip automatic binding mechanism seal bar 184 to be swung down to the position of the binding strip automatic binding mechanism seal bar 184 shown in FIG. 10 by the action of its automatic binding strip seal bar positioning mechanism (not shown) under the control of a controller (not shown). In addition, the binding strip automatic binding mechanism seal bar traveler threaded shaft 186 has been translated laterally by its stepping motor (not shown) under the control of a controller (not shown) to thereby fold the binding strip 150 across the bottom edge (spine area) of the set of sheets 12, as shown in FIG. 10, and extending horizontally as shown in the view of FIG. 10 away from the lower portion of the set of sheets set of sheets 12. Also in this step of the process of the operation of the binding strip automatic binding mechanism 180 the binding strip automatic binding mechanism backing unit rear backing plate 192 has been withdrawn by its holding and retrieval mechanism (not shown) under the control of a controller (not shown) and the binding strip automatic binding mechanism backing unit front backing plate 194 has been moved into a backing position by being released by its holding and retrieval mechanism (not shown) under the control of a controller (not shown) allowing the spring pressure of binding strip automatic binding mechanism backing unit front backing plate spring 210 to push the binding strip automatic binding mechanism backing unit front backing plate 194 against a lower portion of the set of sheets 12 on the side where the binding strip 150 has been heated and/or pressed against the set of sheets 12 by the binding strip automatic binding mechanism seal bar 184 in the step illustrated in FIG. 9. In those embodiments where the binding strip 150 is only a pressure actuated binding strip 150, the binding strip automatic binding mechanism backing unit front backing plate 194 in the step illustrated in FIG. 10 may apply additional pressure for setting the adhesive. In those embodiments where the binding strip 150 is heat actuated or both heat and pressure actuated, the binding strip automatic binding mechanism backing unit front backing plate 194 in the position shown in FIG. 10 may serve, e.g., as a heat sink to speed the cooling of the melted adhesive and facilitate the setting of the adhesive backing on the binding strip 150 at the location of the binding strip automatic binding mechanism backing unit front backing plate 194.

Figure 11:
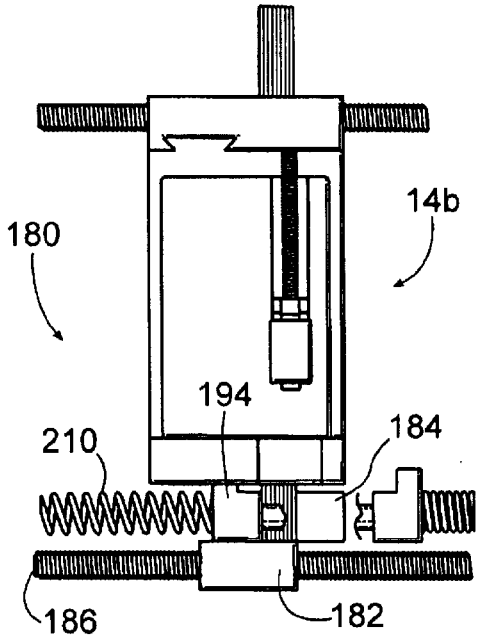

Turning now to FIG. 11, there is shown a succeeding step in the process of the operation of the binding strip automatic binding mechanism 180. In this step, the binding strip automatic binding mechanism seal bar 184 has been rotated by the action of its automatic binding strip seal bar positioning mechanism (not shown) under the action of a controller (not shown) to the position where it is adjacent the lower portion of the set of sheets 12 on the opposite side of the set of sheets 12 from that shown in FIG. 9, consequently also folding the binding strip 150 up along that lower portion of the set of sheets 12 on this opposite side. As on the opposite side as shown in FIG. 9, the binding strip automatic binding mechanism seal bar 184 applies heat and/or pressure to the binding strip 150 in this lower portion of the opposite side of the set of sheets 12 against the backing of the binding strip automatic binding mechanism backing unit front backing plate 194. This may be facilitated by again rotating the binding strip automatic binding mechanism seal bar traveler threaded shaft 186 to move the binding strip automatic binding mechanism seal bar traveler 182 and thus the binding strip automatic binding mechanism seal bar 184 in the left hand direction as illustrated in FIG. 11.

Figure 12:
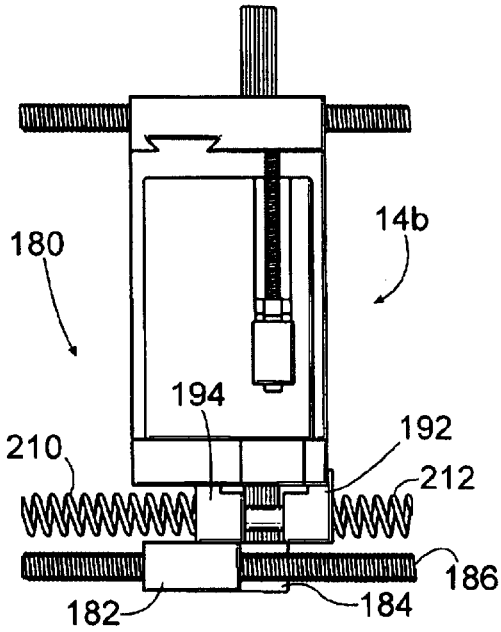

Turning now to FIG. 12, similarly to the operation shown in FIG. 10 the binding strip automatic binding mechanism seal bar 184 has been rotated away from the set of sheets 12 and the binding strip automatic binding mechanism backing unit rear backing plate 192 has been released by its holding and retrieval mechanism (not shown) to move with the spring pressure of the binding strip automatic binding mechanism backing unit rear backing plate spring 212 to engage the binding strip 150 adjacent the lower portion of the set of sheets 12. At the same time, the binding strip automatic binding mechanism seal bar 184 is adjacent the portion of the binding strip 150 across the bottom edge of the set of sheets 12 and can apply heat and/or pressure to the binding strip 150 across this bottom edge (spine area) of the set of sheets 12, e.g., by being rotated toward the bottom edge by its automatic binding strip seal bar positioning mechanism (not shown) under the control of a controller (not shown). It will also be under stood by those in the art that the binding strip automatic binding mechanism seal bar traveler 182 may also be subsequently moved from the position shown in FIG. 12 laterally by the rotation of its stepping motor (not shown) under the control of a controller (not shown) to act as a heat sink to facilitate the cooling of the binding strip 150 across the bottom edge of the set of sheets 12 and thus facilitate the thermal setting of the adhesive, if applicable. It will also be understood by those skilled in the art that the operations described with respect to FIG. 12 may be accomplished as the binding strip automatic binding mechanism seal bar traveler 182 and binding strip automatic binding mechanism seal bar 184 are moving from the position and step shown in FIG. 9 to the position and step shown in FIG. 10.

The foregoing invention has been described in relation to a presently preferred embodiment thereof. The invention should not be considered limited to this embodiment. Those skilled in the art will appreciate that many variations and modifications to the presently preferred embodiment, many of which are specifically referenced above, may be made without departing from the spirit and scope of the appended claims. For example, the invention illustrated by the disclosed embodiment has been describe in terms of horizontal an vertical and laterally and left and right movements and orientations as illustrated in the respective views, but this should not limit the orientation of the various components within a post processing device (not shown). The inventions should be measured in scope from the appended claims.

I claim:

1. An image processing machine, having a housing, and including, within the housing, at least one sheet stack accumulation station at which a stack of sheets having been operated on by the image processing machine are accumulated, and an automated post processing sheet stack binding system comprising:

an automated sheet stack binding station;

a sheet stack transfer mechanism adapted to seize a stack of sheets and to transfer the stack of sheets from the accumulation tray to the automated sheet stack binding station and to hold the stack of sheets in a binding position at the automated sheet stack binding station during a binding operation;

a sheet stack binding strip supply mechanism containing a plurality of sheet stack binding strips;

a sheet stack binding strip transfer mechanism adapted to transfer one of the sheet stack binding strips from the sheet stack binding strip supply mechanism to the automated sheet stack binding station;

the automated sheet stack binding station further comprising an automated sheet stack binding mechanism adapted to attach the sheet stack binding strip to an edge of the stack of sheets and adjacent portions of a top and a bottom sheet contained in the stack of sheets.

2. The apparatus of claim 1 further comprising:

the sheet stack binding strip comprises a generally flat binding strip having a thermally setting adhesive, and the automated sheet stack binding mechanism further comprises a heating element adapted to apply heat to the thermally setting adhesive.

3. The apparatus of claim 1 further comprising:

the sheet stack binding strip comprises a generally flat binding strip having a pressure setting adhesive, and the automated sheet stack binding mechanism further comprises a pressuring element adapted to apply pressure to the thermally setting adhesive.

4. The apparatus of claim 1 further comprising:

the sheet stack binding strip comprises a generally flat binding strip having a thermally and pressure setting adhesive, and the automated sheet stack binding mechanism further comprises a heater element and a pressuring element, cooperatively adapted to apply heat and pressure to the thermally and pressure setting adhesive.

5. The apparatus of claim 1 further comprising:

the sheet stack transfer mechanism further comprising at least one retractable gripping element adapted to engage and grip the stack of sheets at an edge other than the edge to have the sheet stack binding strip applied to it at the automated sheet stack binding station, and a translation mechanism adapted to translate the gripping element from the sheet stack accumulation tray to the automated sheet stack binding station.

6. The apparatus of claim 2 further comprising:

the sheet stack transfer mechanism further comprising at least one retractable gripping element adapted to engage and grip the stack of sheets at an edge other than the edge to have the sheet stack binding strip applied to it at the automated sheet stack binding station, and a translation mechanism adapted to translate the gripping element from the sheet stack accumulation tray to the automated sheet stack binding station.

7. The apparatus of claim 3 further comprising:

the sheet stack transfer mechanism further comprising at least one retractable gripping element adapted to engage and grip the stack of sheets at an edge other than the edge to have the sheet stack binding strip applied to it at the automated sheet stack binding station, and a translation mechanism adapted to translate the gripping element from the sheet stack accumulation tray to the automated sheet stack binding station.

8. The apparatus of claim 4 further comprising:

the sheet stack transfer mechanism further comprising at least one retractable gripping element adapted to engage and grip the stack of sheets at an edge other than the edge to have the sheet stack binding strip applied to it at the automated sheet stack binding station, and a translation mechanism adapted to translate the gripping element from the sheet stack accumulation tray to the automated sheet stack binding station.

9. The apparatus of claim 1 further comprising:

the sheet stack binding strip supply mechanism further comprises a magazine holding the plurality of sheet stack binding strips and adapted to present the plurality of sheet stack binding strips for removal from the magazine one at a time.

10. The apparatus of claim 2 further comprising:

the sheet stack binding strip supply mechanism further comprises a magazine holding the plurality of sheet stack binding strips and adapted to present the plurality of sheet stack binding strips for removal from the magazine one at a time.

11. The apparatus of claim 3 further comprising:

the sheet stack binding strip supply mechanism further comprises a magazine holding the plurality of sheet stack binding strips and adapted to present the plurality of sheet stack binding strips for removal from the magazine one at a time.

12. The apparatus of claim 4 further comprising:

the sheet stack binding strip supply mechanism further comprises a magazine holding the plurality of sheet stack binding strips and adapted to present the plurality of sheet stack binding strips for removal from the magazine one at a time.

13. The apparatus of claim 1 further comprising:

the sheet stack binding strip transfer mechanism further comprises a seizing unit adapted to take hold of a single sheet stack binding strip at a time from the sheet stack binding strip supply mechanism and a delivery mechanism adapted to move the sheet stack binding strip from the sheet stack binding strip supply mechanism to the automated sheet stack binding mechanism in a position ready for binding;

wherein the seizing unit includes a mechanism adapted to move the single sheet stack binding strip from the sheet stack binding strip supply mechanism to the delivery mechanism.

14. The apparatus of claim 2 further comprising:

the sheet stack binding strip transfer mechanism further comprises a seizing unit adapted to take hold of a single sheet stack binding strip at a time from the sheet stack binding strip supply mechanism and a delivery mechanism adapted to move the sheet stack binding strip from the sheet stack binding strip supply mechanism to the automated sheet stack binding mechanism in a position ready for binding;

wherein the seizing unit includes a mechanism adapted to move the single sheet stack binding strip from the sheet stack binding strip supply mechanism to the delivery mechanism.

15. The apparatus of claim 3 further comprising:

the sheet stack binding strip transfer mechanism further comprises a seizing unit adapted to take hold of a single sheet stack binding strip at a time from the sheet stack binding strip supply mechanism and a delivery mechanism adapted to move the sheet stack binding strip from the sheet stack binding strip supply mechanism to the automated sheet stack binding mechanism in a position ready for binding;

wherein the seizing unit includes a mechanism adapted to move the single sheet stack binding strip from the sheet stack binding strip supply mechanism to the delivery mechanism.

16. The apparatus of claim 4 further comprising:

the sheet stack binding strip transfer mechanism further comprises a seizing unit adapted to take hold of a single sheet stack binding strip at a time from the sheet stack binding strip supply mechanism and a delivery mechanism adapted to move the sheet stack binding strip from the sheet stack binding strip supply mechanism to the automated sheet stack binding mechanism in a position ready for binding;

wherein the seizing unit includes a mechanism adapted to move the single sheet stack binding strip from the sheet stack binding strip supply mechanism to the delivery mechanism.

17. An image processing machine, having a housing, and including, within the housing, at least one sheet stack accumulation station at which a stack of sheets having been operated on by the image processing machine are accumulated, and an automated post processing sheet stack binding system comprising:

an automated sheet stack binding station;

a sheet stack transfer means for seizing a stack of sheets and for transferring the stack of sheets from the accumulation tray to the automated sheet stack binding station and holding the stack of sheets in a binding position at the automated sheet stack binding station during a binding operation;

a sheet stack binding strip supply mechanism containing a plurality of sheet stack binding strips;

a sheet stack binding strip transfer means for transferring one of the sheet stack binding strips from the sheet stack binding strip supply mechanism to the automated sheet stack binding station;

the automated sheet stack binding station further comprising an automated sheet stack binding means for attaching the sheet stack binding strip to an edge of the stack of sheets and adjacent portions of a top and a bottom sheet contained in the stack of sheets.

18. The apparatus of claim 17 further comprising:

the sheet stack binding strip comprises a generally flat binding strip having a thermally setting adhesive, and the automated sheet stack binding means further comprises a heating means for applying heat to the thermally setting adhesive.

19. The apparatus of claim 17 further comprising:

the sheet stack binding strip comprises a generally flat binding strip having a pressure setting adhesive, and the automated sheet stack binding means further comprises a pressuring means for applying pressure to the thermally setting adhesive.

20. The apparatus of claim 17 further comprising:

the sheet stack binding strip comprises a generally flat binding strip having a thermally and pressure setting adhesive, and the automated sheet stack binding means further comprises a heater means and a pressuring means, for cooperatively applying heat and pressure to the thermally and pressure setting adhesive.

21. The apparatus of claim 17 further comprising:

the sheet stack transfer means further comprising at least one retractable gripping means for engaging and gripping the stack of sheets at an edge other than the edge to have the sheet stack binding strip applied to it at the automated sheet stack binding station, and a translation means for translating the gripping means from the sheet stack accumulation tray to the automated sheet stack binding station.

22. The apparatus of claim 18 further comprising:

the sheet stack transfer means further comprising at least one retractable gripping means for engaging and gripping the stack of sheets at an edge other than the edge to have the sheet stack binding strip applied to it at the automated sheet stack binding station, and a translation means for translating the gripping means from the sheet stack accumulation tray to the automated sheet stack binding station.

23. The apparatus of claim 19 further comprising:

the sheet stack transfer means further comprising at least one retractable gripping means for engaging and gripping the stack of sheets at an edge other than the edge to have the sheet stack binding strip applied to it at the automated sheet stack binding station, and a translation means for translating the gripping means from the sheet stack accumulation tray to the automated sheet stack binding station.

24. The apparatus of claim 20 further comprising:

the sheet stack transfer means further comprising at least one retractable gripping means for engaging and gripping the stack of sheets at an edge other than the edge to have the sheet stack binding strip applied to it at the automated sheet stack binding station, and a translation means for translating the gripping means from the sheet stack accumulation tray to the automated sheet stack binding station.

25. The apparatus of claim 17 further comprising:

the sheet stack binding strip supply mechanism further comprises a magazine holding the plurality of sheet stack binding strips and includes means for presenting the plurality of sheet stack binding strips for removal from the magazine one at a time.

26. The apparatus of claim 18 further comprising:

the sheet stack binding strip supply mechanism further comprises a magazine holding the plurality of sheet stack binding strips and includes means for presenting the plurality of sheet stack binding strips for removal from the magazine one at a time.

27. The apparatus of claim 19 further comprising:

the sheet stack binding strip supply mechanism further comprises a magazine holding the plurality of sheet stack binding strips and includes means for presenting the plurality of sheet stack binding strips for removal from the magazine one at a time.

28. The apparatus of claim 20 further comprising:

the sheet stack binding strip supply mechanism further comprises a magazine holding the plurality of sheet stack binding strips and includes means for presenting the plurality of sheet stack binding strips for removal from the magazine one at a time.

29. The apparatus of claim 17 further comprising:

the sheet stack binding strip transfer means further comprises a seizing means for taking hold of a single sheet stack binding strip at a time from the sheet stack binding strip supply mechanism and a delivery means for moving the sheet stack binding strip from the stack binding strip supply mechanism to the automated sheet stack binding means in a position ready for binding;

wherein the seizing means includes a means for moving the single sheet stack binding strip from the sheet stack binding strip supply mechanism to the delivery mechanism.

30. The apparatus of claim 18 further comprising:

the sheet stack binding strip transfer means further comprises a seizing means for taking hold of a single sheet stack binding strip at a time from the sheet stack binding strip supply mechanism and a delivery means for moving the sheet stack binding strip from the stack binding strip supply mechanism to the automated sheet stack binding means in a position ready for binding;

wherein the seizing means includes a means for moving the single sheet stack binding strip from the sheet stack binding strip supply mechanism to the delivery mechanism.

31. The apparatus of claim 19 further comprising:

the sheet stack binding strip transfer means further comprises a seizing means for taking hold of a single sheet stack binding strip at a time from the sheet stack binding strip supply mechanism and a delivery means for moving the sheet stack binding strip from the stack binding strip supply mechanism to the automated sheet stack binding means in a position ready for binding;

wherein the seizing means includes a means for moving the single sheet stack binding strip from the sheet stack binding strip supply mechanism to the delivery mechanism.

32. The apparatus of claim 20 further comprising:

the sheet stack binding strip transfer means further comprises a seizing means for taking hold of a single sheet stack binding strip at a time from the sheet stack binding strip supply mechanism and a delivery means for moving the sheet stack binding strip from the stack binding strip supply mechanism to the automated sheet stack binding means in a position ready for binding;

wherein the seizing means includes a means for moving the single sheet stack binding strip from the sheet stack binding strip supply mechanism to the delivery mechanism.

33. In an image processing machine, having a housing, and including, within the housing, and at least one sheet stack accumulation station at which a stack of sheets having been operated on by the image processing machine are accumulated, and method of automated post processing binding of a stack of sheets comprising:

providing an automated sheet stack binding station;

seizing a stack of sheets and transferring the stack of sheets from the accumulation tray to an automated sheet stack binding station and holding the sheet stack in a binding position at the automated sheet stack binding station during a binding operation;

providing a sheet stack binding strip supply mechanism containing a plurality of sheet stack binding strips;

transferring one of the sheet stack binding strips from the sheet stack binding strip supply mechanism to the automated sheet stack binding station;

attaching the binding strip to an edge of the stack of sheets and adjacent portions of a top and a bottom sheet contained in the stack of sheets utilizing an automated sheet stack binding mechanism.

34. The method of claim 33 further comprising:

the sheet stack binding strip comprises a generally flat binding strip having a thermally setting adhesive, and the automated sheet stack binding mechanism performs a step of applying heat to the thermally setting adhesive.

35. The apparatus of claim 33 further comprising:

the sheet stack binding strip comprises a generally flat binding strip having a pressure setting adhesive, and the automated sheet stack binding mechanism performs a step of applying pressure to the thermally setting adhesive.

36. The method of claim 33 further comprising:

the sheet stack binding strip comprises a generally flat binding strip having a thermally and pressure setting adhesive, and the automated sheet stack binding mechanism performs a step of applying heat and pressure to the thermally and pressure setting adhesive.

37. The method of claim 33 further comprising:

the step of seizing is performed by at least one retractable gripping mechanism, which performs steps of engaging and gripping an edge of the stack of sheets other than the edge to have the binding strip applied to it at the automated sheet stack binding station, and translating the gripping means from the sheet stack accumulation tray to the automated sheet stack binding station.

38. The method of claim 34 further comprising:

the step of seizing is performed by at least one retractable gripping mechanism, which performs steps of engaging and gripping an edge of the stack of sheets other than the edge to have the binding strip applied to it at the automated sheet stack binding station, and translating the gripping means from the sheet stack accumulation tray to the automated sheet stack binding station.

39. The method of claim 35 further comprising:

the step of seizing is performed by at least one retractable gripping mechanism, which performs steps of engaging and gripping an edge of the stack of sheets other than the edge to have the binding strip applied to it at the automated sheet stack binding station, and translating the gripping means from the sheet stack accumulation tray to the automated sheet stack binding station.

40. The method of claim 36 further comprising:

the step of seizing is performed by at least one retractable gripping mechanism, which performs steps of engaging and gripping an edge of the stack of sheets other than the edge to have the binding strip applied to it at the automated sheet stack binding station, and translating the gripping means from the sheet stack accumulation tray to the automated sheet stack binding station.

41. The method of claim 33 further comprising:

the sheet stack binding strip supply mechanism further comprises a magazine holding the plurality of sheet stack binding strips and performs a step of presenting the plurality of sheet stack binding strips for removal from the magazine one at a time.

42. The method of claim 34 further comprising:

the sheet stack binding strip supply mechanism further comprises a magazine holding the plurality of sheet stack binding strips and performs a step of presenting the plurality of sheet stack binding strips for removal from the magazine one at a time.

43. The method of claim 35 further comprising:

the sheet stack binding strip supply mechanism further comprises a magazine holding the plurality of sheet stack binding strips and performs a step of presenting the plurality of sheet stack binding strips for removal from the magazine one at a time.

44. The method of claim 36 further comprising:

the sheet stack binding strip supply mechanism further comprises a magazine holding the plurality of sheet stack binding strips and performs a step of presenting the plurality of sheet stack binding strips for removal from the magazine one at a time.

45. The method of claim 33 further comprising:

taking hold of a single sheet stack binding strip at a time from the sheet stack binding strip supply mechanism and delivering the sheet stack binding strip from the sheet stack binding strip supply mechanism to the automated sheet stack binding means in a position ready for binding, by moving the single sheet stack binding strip from the sheet stack binding strip supply mechanism to a delivery mechanism.

46. The method of claim 34 further comprising:

taking hold of a single sheet stack binding strip at a time from the sheet stack binding strip supply mechanism and delivering the sheet stack binding strip from the sheet stack binding strip supply mechanism to the automated sheet stack binding means in a position ready for binding, by moving the single sheet stack binding strip from the sheet stack binding strip supply mechanism to a delivery mechanism.

47. The method of claim 35 further comprising:

taking hold of a single sheet stack binding strip at a time from the sheet stack binding strip supply mechanism and delivering the sheet stack binding strip from the sheet stack binding strip supply mechanism to the automated sheet stack binding means in a position ready for binding, by moving the single sheet stack binding strip from the sheet stack binding strip supply mechanism to a delivery mechanism.

48. The method of claim 36 further comprising:

taking hold of a single sheet stack binding strip at a time from the sheet stack binding strip supply mechanism and delivering the sheet stack binding strip from the sheet stack binding strip supply mechanism to the automated sheet stack binding means in a position ready for binding, by moving the single sheet stack binding strip from the sheet stack binding strip supply mechanism to a delivery mechanism.

* * * * *